US006009737A

United States Patent [19]

Bandy

[11] Patent Number: 6,009,737

[45] Date of Patent: Jan. 4, 2000

[54] TUBE BENDER

[75] Inventor: Mark E. Bandy, Columbus, Ind.

[73] Assignee: Arvin Industries, Inc., Columbus, Ind.

[21] Appl. No.: 08/896,030

[22] Filed: Jul. 17, 1997

[51] Int. Cl.[7] ..... B21D 9/05

[52] U.S. Cl. ..... 72/150; 279/2.03

[58] Field of Search ..... 72/97, 149, 150, 72/159, 369, 370.01, 370.08, 393, 398, 419, 426, 428; 279/2.03, 2.12, 2.13, 2.14, 2.15

[56] References Cited

U.S. PATENT DOCUMENTS

| | | |
|---|---|---|
| 1,946,629 | 2/1934 | Laughlin . |
| 1,993,361 | 5/1935 | Cornell, Jr. . |
| 1,996,838 | 4/1935 | Snell . |
| 2,018,452 | 10/1935 | Laughlin . |
| 2,219,008 | 10/1940 | Drissner . |
| 2,291,397 | 7/1942 | Martin . |
| 2,291,398 | 7/1942 | Martin . |
| 2,363,889 | 11/1944 | Martin . |
| 2,382,060 | 8/1945 | Ingalls . |
| 2,407,083 | 9/1946 | Koppel . |
| 2,433,230 | 12/1947 | Martin . |
| 2,551,077 | 5/1951 | Wilson . |
| 2,681,808 | 6/1954 | O'Connell . |
| 2,821,404 | 1/1958 | Sloan . |
| 2,831,523 | 4/1958 | Wurzburger . |
| 2,996,100 | 8/1961 | Newhall et al. . |
| 3,109,477 | 11/1963 | Avera et al. . |
| 3,117,797 | 1/1964 | Buck . |
| 3,383,723 | 5/1968 | Connelly . |
| 3,385,607 | 5/1968 | Hughes . |
| 3,650,136 | 3/1972 | Sindelar . |
| 3,747,394 | 7/1973 | Cunningham . |
| 3,851,519 | 12/1974 | Calvin et al. . |
| 3,964,290 | 6/1976 | Auxer . |
| 3,974,676 | 8/1976 | Eaton . |
| 4,027,522 | 6/1977 | Clavin . |
| 4,063,441 | 12/1977 | Eaton . |
| 4,080,814 | 3/1978 | Eaton . |
| 4,086,803 | 5/1978 | Wheeler . |
| 4,088,007 | 5/1978 | Clavin . |
| 4,130,004 | 12/1978 | Eaton . |
| 4,178,788 | 12/1979 | Zollweg et al. . |
| 4,193,607 | 3/1980 | Pearson et al. . |
| 4,201,073 | 5/1980 | Eaton . |
| 4,214,766 | 7/1980 | Rall et al. . |
| 4,232,813 | 11/1980 | Eaton . |
| 4,251,084 | 2/1981 | Franklin . |
| 4,269,054 | 5/1981 | Eaton . |
| 4,289,012 | 9/1981 | Nessi . |
| 4,309,041 | 1/1982 | Peterson et al. . |
| 4,352,285 | 10/1982 | LaRue et al. . |
| 4,495,788 | 1/1985 | Traub . |
| 4,625,531 | 12/1986 | Lafrasse et al. . |
| 4,635,464 | 1/1987 | McGuire et al. . |
| 4,732,025 | 3/1988 | Marlinga et al. . |
| 4,744,233 | 5/1988 | Trudell . |

(List continued on next page.)

*Primary Examiner*—Rodney Butler
*Attorney, Agent, or Firm*—Barnes & Thornburg

[57] ABSTRACT

A tube-bending machine is provided for forming a tubular work piece having an inner surface. The tube-bending machine comprises a die assembly for forming the tubular work piece to assume a bent shape, actuator systems configured to move the tubular work piece to predetermined positions relative to the die assembly, a mandrel assembly including a mandrel rod having a first end and a second end spaced apart from the first end and a plurality of mandrel balls attached to the second end of the mandrel rod, and a gripping device for gripping the inner surface of the tubular work piece during advancement of the tube towards the die assembly. The first end of the mandrel rod is attached to the actuator. The gripping device is coupled to the actuator system and formed to include a mandrel rod-receiving aperture. The mandrel rod is positioned to lie in the mandrel rod-receiving aperture.

57 Claims, 2 Drawing Sheets

U.S. PATENT DOCUMENTS

| | | | |
|---|---|---|---|
| 4,750,346 | 6/1988 | Traub . | |
| 4,760,726 | 8/1988 | Traub . | |
| 4,768,269 | 9/1988 | Williams . | |
| 4,867,463 | 9/1989 | Hopf | 279/46 R |
| 4,870,849 | 10/1989 | Traub . | |
| 4,916,952 | 4/1990 | Thielmann et al. . | |
| 4,959,984 | 10/1990 | Trudell et al. | 72/150 |
| 4,989,435 | 2/1991 | Kaneko . | |
| 5,008,555 | 4/1991 | Mundy . | |
| 5,113,683 | 5/1992 | Lafrasse . | |
| 5,149,111 | 9/1992 | Han | 279/2.03 |
| 5,195,343 | 3/1993 | Malarz . | |
| 5,343,725 | 9/1994 | Sabine . | |
| 5,406,821 | 4/1995 | Sabine et al. | 72/150 |
| 5,429,375 | 7/1995 | Mueller et al. | 279/2.03 |
| 5,481,891 | 1/1996 | Sabine . | |

PROXIMITY SWITCH
PROXIMITY SWITCH

TUBE BENDER

BACKGROUND AND SUMMARY OF THE INVENTION

The present invention relates to a tube bender, and particularly to apparatus and methods for bending tubes of the type included in vehicle exhaust systems. More particularly, the present invention relates to a tube bender including a collet that is configured to grip a tube and also including a mandrel rod passing through the collet and into the tube.

A tube bender or tube-bending machine forms a tube into a desired shape by bending the tube at selected locations along the length of the tube in a tube-bending process. The first step in the tube-bending process is to mount an end of the tube on a collet included in the tube bender. Once mounted on the collet, the tube is moved relative to a die assembly also included in the tube bender. The die assembly engages the outer surface of the tube to form the tube so that it is moved to assume a desired bent shape.

Conventional tube benders include an external collet that grips the outer surface of the tube to be formed or bent in the tube bender. Because both the external collet and die assembly engage the outer surface of the tube, the external collet and die assembly must be spaced apart from one another to avoid interfering with one another. Because the external collet covers a portion of the tube and must be spaced apart from the die assembly, the end of the tube coupled to the external collet is prevented from being moved as close to the die assembly as desired when placing a bend in the end of the tube. This results in the end of the tube having an "unbendable portion" that typically is one to four inches (2.5 cm to 10.2 cm) in length. Such an unbendable portion (i.e. a portion that cannot be bent or otherwise formed in the die assembly) becomes a material-waste portion if a bend is required to be formed near the end of the tube. This material-waste portion of the tube must be removed by a cutting procedure. Thus, use of a conventional outer surface-gripping, external collet wastes material and increases manufacturing time and labor costs.

In a conventional tube-bending process known as "mandrel bending," a mandrel assembly is moved through a mandrel-receiving passageway formed in the external collet. The mandrel assembly includes a mandrel rod and a mandrel ball assembly coupled to the mandrel rod and positioned to lie within the tube adjacent to the die assembly to prevent the tube from "flattening out" during the tube-bending process. The mandrel ball assembly fills the tube at the location where the tube is being bent and thus prevents that portion of the tube at that location from being flattened.

According to the present invention, a tube-bending machine is provided for forming a tubular work piece having an inner surface. The tube-bending machine comprises a die assembly for forming the tubular work piece to assume a bent shape, an actuator system configured to move the tubular work piece to predetermined positions relative to the die assembly, a mandrel assembly including a mandrel rod having a first end and a second end spaced apart from the first end and a plurality of mandrel balls attached to the second end of the mandrel rod, and gripping means for gripping the inner surface of the tubular work piece during advancement of the tube towards the die assembly. The first end of the mandrel rod is attached to the actuator. The gripping means is coupled to the actuator system and formed to include a mandrel rod-receiving aperture. The mandrel rod is positioned to lie in the mandrel rod-receiving aperture.

In preferred embodiments of the present invention, the gripping means is an internal collet and an arbor assembly that allows the tube bender to move a tube towards the die assembly without interfering with the die assembly or other components of the tube bender. This allows a tube bender equipped with an internal collet configured to grip an inner surface of the tubular work piece to bend a portion of the tube not previously bendable by conventional outer surface-gripping, external collets. An internal collet in accordance with the present invention permits the end of the tube coupled to the internal collet to be placed closer to the die assembly than allowed by an external collet. This inner surface-gripping, internal collet reduces the amount of material waste and often eliminates the manufacturing step of cutting the material-waste portion off the tube. The present invention also allows for a mandrel assembly to be moved through a mandrel-receiving passageway formed in the internal collet to reduce the potential of the tube flattening during the tube-bending process.

A method in accordance with the present invention is provided for gripping a tube on a tube bender. The method includes the step of providing a tube having a collet-engaging end and an inner surface, a tube bender including a gripping assembly, and a mandrel assembly having a mandrel rod. The gripping assembly includes a collet having a plurality of tines and an arbor assembly having a mandrel rod-receiving aperture. The mandrel rod extends through the mandrel rod-receiving aperture. The collet-engaging end of the tube is placed over the plurality of tines of the collet. The arbor assembly moves relative to the collet so that the arbor assembly expands the plurality of tines to an expanded position so that the plurality of tines grip the inner surface of the tube. After the gripping assembly mounts the tube on the tube bender, the actuator system advances the tube to predetermined locations in relationship to the die assembly. The actuator system then advances the tube for each subsequent bend. After the tube has been advanced for the last bend and the die assembly has clamped the tube, the gripping assembly releases the tube and the actuator system removes the gripping assembly away from the die assembly.

In preferred embodiment of the present invention, the method of gripping a tube is provided where the tube end being gripped on its inner surface can be placed closer to the die assembly. By placing the tube end being gripped closer to the die assembly, bends can be placed in the end being gripped without leaving an unbendable waste portion that must later be removed. Thus, material is not wasted that must be cut off and disposed of at a later time. Furthermore, the method of the present invention provides a step for reducing or eliminating the potential for the tube to flatten out while being bent by the die assembly.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
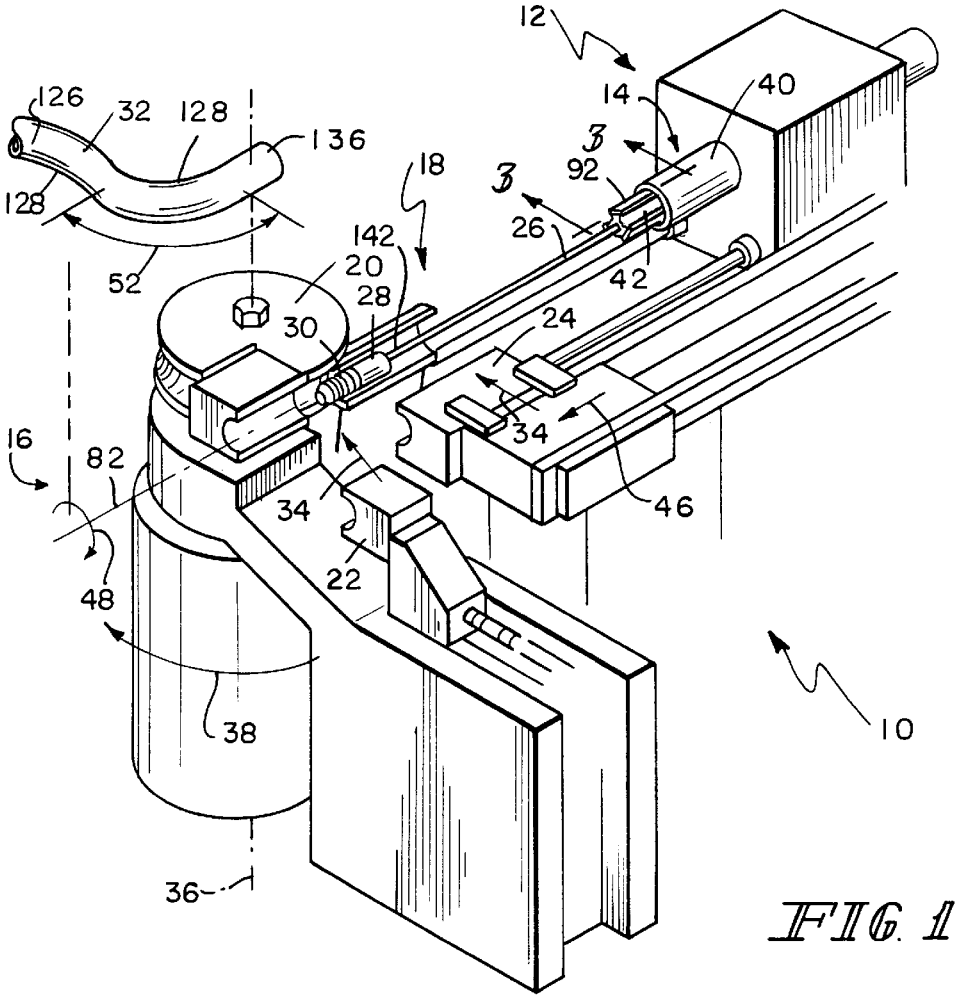
FIG. 1 is a perspective view of a tube bender used for the manufacture of muffler pipes showing the tube bender including a die assembly, an actuator system, a gripping assembly connected to the actuator system, and a mandrel assembly extending between the gripping assembly and the die assembly.

In a representative embodiment of the present invention, as shown in FIG. 1, a tube-bending machine or tube bender 10 for bending a tube or work piece 32 includes a movement actuator system 12, a gripping assembly 14, a work piece bending-die assembly 16, and a mandrel assembly 18. Gripping assembly 14 is coupled to actuator system 12 and mandrel assembly 18 extends through gripping assembly 14 between actuator system 12 and die assembly 16.

Figure 2:
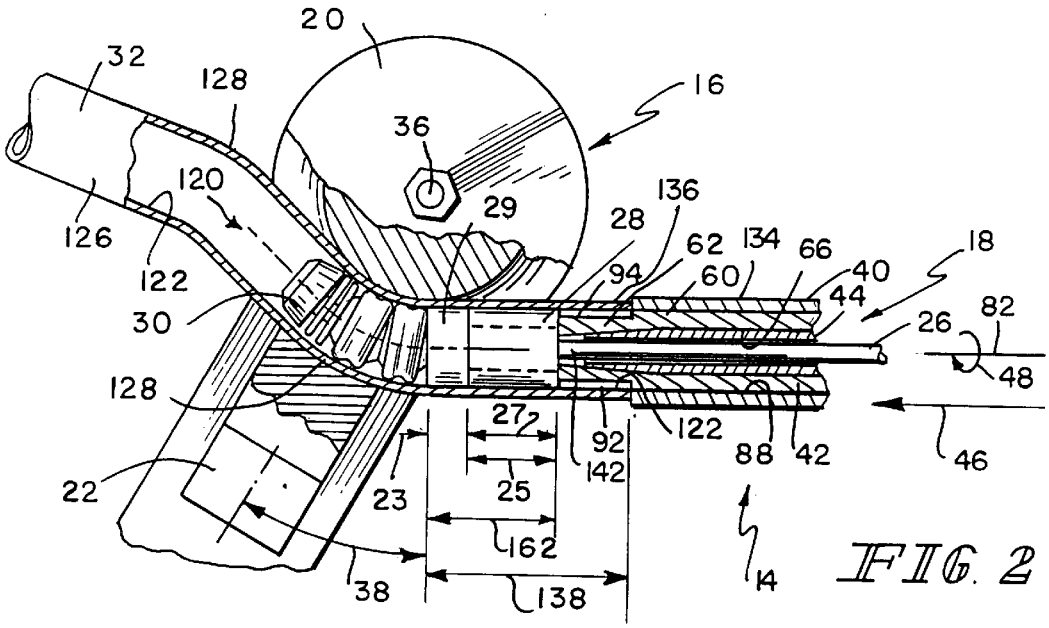
FIG. 2 is a top plan view of the die assembly, with portions cut away, showing a tube extending over the mandrel assembly and being coupled to the gripping assembly and the die assembly forming the tube into a desired shape.

Tube 32 is shown in FIGS. 1 and 2 and includes an inner surface 122 defining a central aperture or tube passageway 120 and an outer surface 126 spaced apart from inner surface 122. Tube 32 also includes predetermined bending portions 128 moved near die assembly 16 for bending and a collet-engaging end 136 as shown, for example, in FIG. 2.

Figures 3, 4, 5, 6, 7:
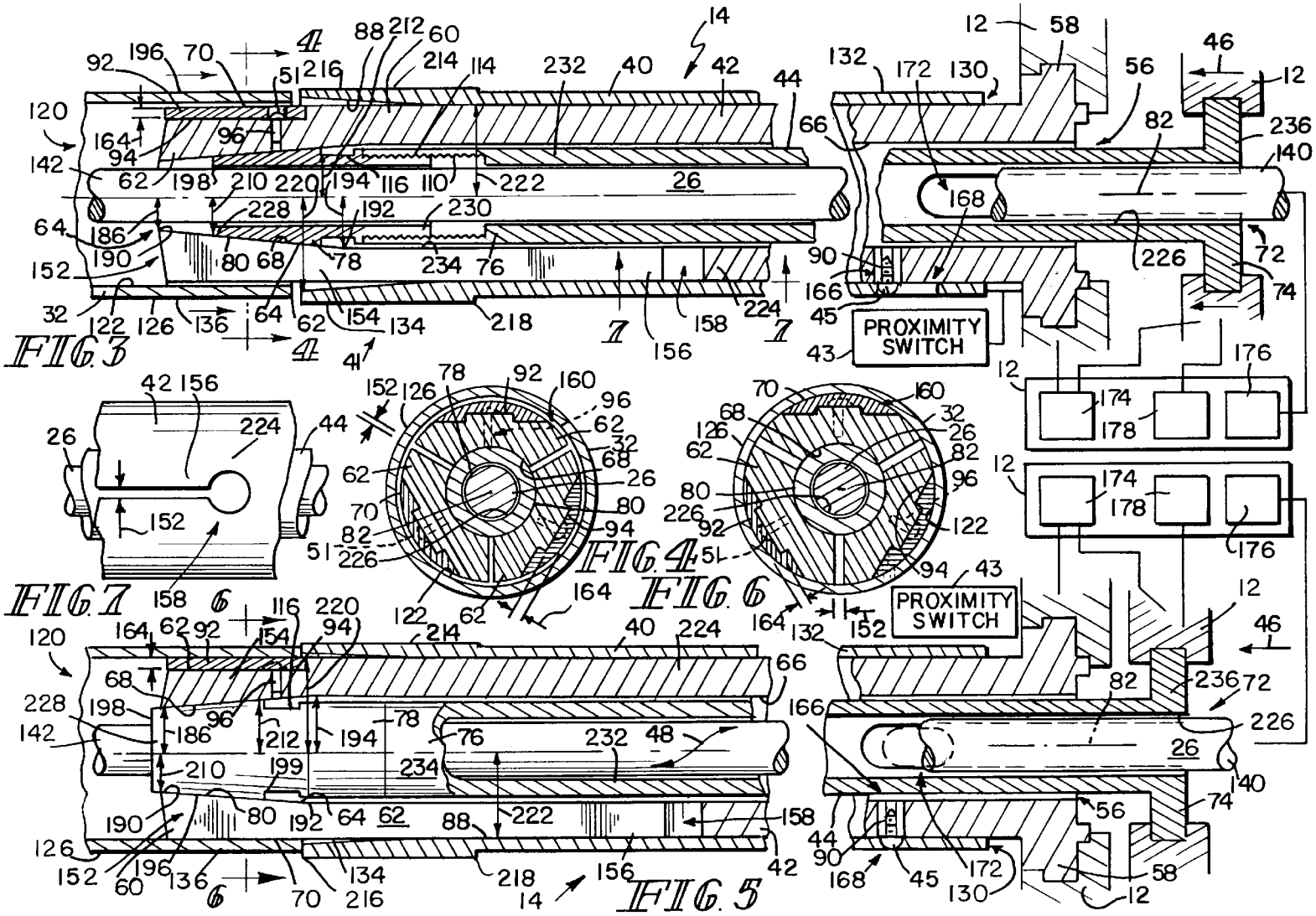
FIG. 3 is a sectional view taken along line 3—3 of FIG. 1 showing the gripping assembly including a tube stop, an arbor assembly extending through the tube stop, and collet having tines and being positioned to lie between the tube stop and arbor assembly, the collet being in a disengaged position, the arbor assembly being in a retracted position, and the tines being in a contracted position spaced apart from the inner surface of the tube.
FIG. 4 is a sectional view taken along line 4—4 of FIG. 3 showing the tines being in the contracted position spaced apart from the inner surface of the tube.
FIG. 5 is a sectional view similar to FIG. 3 showing the collet in an engaged position due to the arbor assembly forcing the tines into an expanded position so that the tines engage the inner surface of the tube.
FIG. 6 is a sectional view, similar to FIG. 4, taken along line 6—6 of FIG. 5 showing gripping contact between the tines and the tube due to the tines being in the expanded position.
FIG. 7 is a sectional view taken along line 7—7 of FIG. 3 with the tube stop removed to show a gap bulge for reducing stress concentration at tine attachment points.

Gripping assembly 14 grips inner surface 122 of tube 32 as shown in FIGS. 2, 5, and 6. Therefore, no portion of outer surface 126 of tube 32 is covered by gripping assembly 14. As a result, gripping assembly 14 does not interfere with die assembly 16 or other equipment during movement of collet-engaging end 136 of tube 32 towards die assembly 16. A conventional external collet (not shown) could experience such interference with the die assembly 16 or other portion of tube bender 10 because both the external collet and the die assembly 16 engage the outer surface 126 of tube 32. Therefore, a distance 138, measured between collet-engaging end 136 of tube 32 and die assembly 16 as shown in FIG. 2, that tube 32 is unable to travel because of interference with die assembly 16 is less for internal gripping assembly 14 than for a conventional external collet. Because of this decreased distance 138, actuator system 12 can move tube 32 closer to die assembly 16 and permits die assembly 16 to bend tube 32 closer to collet-engaging end 136 of tube 32 than previously possible. By permitting bending closer to collet-engaging end 136 of tube 32, less material waste is generated.

During a typical tube-bending process, tube 32 is partially placed over gripping assembly 14 by a worker (not shown) or a machine (not shown). Gripping assembly 14 then grips inner surface 122 of tube 32 and mounts tube 32 to actuator system 12 as discussed in greater detail below. Thereafter, actuator system 12 moves tube 32 in a tube-advancing direction 46 along a central axis 82 of gripping assembly 14 and a tube-rotating direction 48 about central axis 82. This movement places a predetermined bending portion 128 of tube 32 in a predetermined position axially and radially along central axis 82 in relation to die assembly 16. Next, die assembly 16 grips outer surface 126 of tube 32 and bends predetermined bending portion 128 of tube 32 as shown, for example, in FIG. 2. Thereafter, tube 32 is moved and bent by tube-bending machine 10 until all necessary bends are made to tube 32. Once tube 32 is formed in the desired manner, tube 32 is released from gripping assembly 14 and tube bender 10. As previously mentioned, gripping assembly 14 grips inner surface 122 of tube 32 allowing tube 32 to be moved close to die assembly 16 to create less material waste.

Gripping assembly 14 of the present invention comprises a tube stop 40 and a tube gripper 41 positioned to lie in tube stop 40 as shown in FIGS. 2, 3, and 5. Tube gripper 41 includes a collet 42 and an arbor assembly 44 as shown, for example, in FIGS. 3 and 5. Tube stop 40 functions primarily as a physical blockade to stop tube 32 at a proper position in relation to collet 42 and an activator of a proximity switch 43. Proximity switch 43 causes actuator system 12 to activate gripping assembly 14 to grip inner surface 122 of tube 32. Actuator system 12 manipulates the components of gripping assembly 14 to grip inner surface 122 of tube 32 and also move tube 32 and mandrel assembly 18 5 relative to die assembly 16. Actuator system 12 is preferably an Eaton-Leonard Model Number VB-300-HP and includes first, second, and third actuators 174, 176, and 178. Such an actuator is well-known in the art so that other such devices may also be used in accordance with the present invention.

Tube stop 40 is substantially cylinder-shaped and includes a mount end 132, a tube-engaging end 134 spaced apart from mount end 132, an inner surface 88 defining a gripping assembly-receiving aperture 130 extending between mount end 132 and tube-engaging end 134, and a motion-limiting aperture 168 as shown, for example, in FIG. 3. When a user places tube 32 against tube-engaging end 134 of tube stop 40, the proximity switch 43 activates third actuator 178 of actuator system 12 as mentioned above. The positioning of tube 32 and the activation of third actuator 178 of actuator system 12 can also be accomplished by other means not using tube stop 40 and proximity switch 43 such as manual activation. According to the present invention, tube stop 40 is made of O-1 tool steel with a Rc hardness of 54–56. However, other suitable materials may also be used with gripping assembly 14 of the present invention.

Collet 42 is substantially cylinder-shaped and positioned to lie substantially within gripping assembly-receiving aperture 130 formed in tube stop 40 as shown, for example, in FIGS. 3 and 5. Collet 42 includes a base end 58 coupled to actuator system 12, a tine end 60 spaced apart from base end 58, a plurality of tine attachment points 224 positioned to lie between base end 58 and tine end 60, a plurality of tines 62 attached to tine attachment points 224, an inner surface 66 facing toward central axis 82, a motion-limiting aperture 166, and a pair of mounting channels (not shown) formed in base end 58 of collet 42. Collet 42 is attached to actuator system 12 at base end 58 of collet 42 with the pair of mounting channels aiding in adapting collet 42 to actuator system 12.

A cap screw 43 having a head 45 is screwed into motion-limiting aperture 166 of collet 42 so that head 45 of cap screw 43 is positioned to lie in motion-limiting aperture 168 of tube stop 40. This limits the range of relative motion of tube stop 40 to collet 42 to prevent tube stop 40 from traveling along collet 42 and falling off gripping assembly 14 during movement of gripping assembly 14.

Each of plurality of tines 62 includes a tube-engaging surface 70 facing away from central axis 82 and an arbor-engaging surface 68 facing toward central axis 82. Each of the plurality of tines 62 include a first end 154 and a second end 156 connected to tine attachment point 224 and spaced apart from first end 154. Plurality of tines 62 cooperate to form tine gaps 152 therebetween as shown, for example, in FIGS. 4, 6, and 7. Likewise, plurality of tines 62 cooperate to form gap bulges 158 located at second end 156 of tines 62 to reduce stress concentrations and the potential for fatigue failure as shown in FIGS. 3, 5, and 7. In the present invention, the plurality of tines 62 consist of three tines 62. However, in alternative embodiments of the present invention, any number of tines may be used.

In the present invention, collet 42 further includes a plurality of tine pads 92 mounted on an exterior surface 94 of plurality of tines 62. Tines 62 are also formed to include tine pad-mounting apertures 96. Tine pads 92 are mounted on exterior surface 94 of tines 62 by a cap screw 51 or comparable fastening device mounted within tine pad-mounting apertures 96. By providing tine pads 92 to grip inner surface 122 of tube 32, only tine pads 92 need to be replaced after normal wear and tear due to use of gripping assembly 14. Furthermore, each tine pad 92 includes a thickness 164 that can be selected to adjust the size of tube 32 to be gripped. Therefore, not only can gripping assembly 14 be made in various sizes to grip various sizes of tubes 32, but tine pads 92 can also be sized to increase the size range of tubes 32 that can be gripped. According to the present invention, tine pads 92 are made of D2 tool steel having a Rc hardness of 56–58. However, other suitable materials may also be used.

Inner surface 66 of collet 42 defines an arbor-receiving passageway 56 extending between base end 58 and tine end 60 and having a tapered portion 64 defining a region that is shaped as a truncated cone. Tapered portion 64 includes a first end 190 contiguous with tine end 180 of collet 42 and a second end 192 spaced apart from first end 190 of tapered portion 64. Inner surface 66 of collet 42 is spaced apart from central axis 82 by a first distance 186 at first end 190 of tapered portion 64 and a second distance 194 at the second end 192 of tapered portion 64. Second distance 194 is greater that first distance 186. In alternative embodiments of the present invention, first distance 186 may be greater than second distance 194. According to the present invention, tapered portion 64 is round. However, other shaped tapered portions 64 may also be used with the present invention. Collet 42 is made of 8620 high carbon steel with a Rc hardness of 50–52. However, other suitable materials may also be used for collet 42 of gripping assembly 14 of the present invention.

Arbor assembly 44 is substantially cylinder-shaped and positioned to lie substantially within arbor-receiving passageway 56 formed in collet 42. Arbor assembly 44 includes a foot end 74, an arbor tip end 76 spaced apart from foot end 74, an inner surface 226 defining a mandrel rod-receiving passageway 72 extending between arbor tip end 76 and foot end 74, an arbor tip 78 having a first end 228 and a second end 230 spaced apart from first end 228, an arbor column 232 having a first end 234 and a second end 236 spaced apart from first end 234, and a pair of mounting channels 172 formed in arbor assembly 44 at foot end 74. Arbor assembly 44 is attached to actuator system 12 at foot end 74 of arbor assembly 44 with pair of mounting channels 172 aiding in adapting arbor assembly 44 to actuator system 12. Furthermore, second end 230 of arbor tip 78 is attached to first end 234 of arbor column 232. According to the present invention, arbor column 232 is made of 8620 high carbon steel. However, other suitable materials may also be used.

Arbor tip 78 includes a tine-engaging surface 80 facing away from central axis 82. Tine-engaging surface 80 includes a tapered portion 196 shaped as a second truncated cone having a first end 198 contiguous with arbor tip end 76 of arbor assembly 44 and a second end 199 spaced apart from first end 198. Tine-engaging surface 80 is spaced apart from central axis 82 by a first distance 210 at first end 198 and a second distance 212 at the second end 199. Second distance 212 is greater that first distance 210. In alternative embodiments, first distance 210 may be greater than second distance 212. According to the present invention, tine-engaging surface 80 is round. However, other shaped tine-engaging surfaces 80 may also be used with the present invention. According to the present invention, arbor tip 78 is made of Ampco 18. However, other suitable materials may also be used.

According to the present invention, second end 230 of arbor tip 78 is releasably attached to arbor column 232. As illustrated in FIG. 3, inner surface 226 of arbor assembly 44 is formed to include a threaded interior diameter portion 110 at first end 234 of arbor column 232. Second end 230 of arbor tip 78 includes a threaded exterior diameter portion 114. Threaded interior diameter portion 110 of inner surface 226 of arbor assembly 44 and threaded exterior diameter portion 114 of first end 228 of arbor tip 78 are formed to match and provide screw-thread attachment between arbor tip 78 and arbor column 232. Therefore, second end 230 of arbor tip 78 is releasably screwed onto the first end 234 of the arbor column 232.

Because arbor tip 78 is releasably attached to arbor column 232, arbor tips 78 of various sizes may be attached to arbor column 232 to match various sizes of collets 42 that accommodate various sizes of tubes 32. Also, arbor tip 78 may be replaced due to wear and tear that occurs during the operation of gripping assembly 14. To accommodate the attachment of arbor tip 78 to arbor column 232, arbor tip 78 is formed to include wrench flats 116, as shown, for example, in FIGS. 3 and 5. Other attachment methods are also functional for attaching arbor tip 78 to arbor column 232. Furthermore, it is also possible to form arbor tip 78 integrally with arbor column 232 so that arbor assembly 44 comprises only one piece.

As previously mentioned, when tube 32 abuts tube stop 40, proximity switch 43 activates third actuator 178 of actuator system 12. Activation of third actuator 178 moves arbor assembly 44 from a retracted position as shown for example, in FIGS. 3 and 5 in tube-advancing direction 46 relative to collet 42 to an extended position as shown, for example, in FIGS. 5 and 6.

The axial motion of arbor assembly 44 between the retracted and extended position relative to collet 42 causes tine-engaging surfaces 80 of arbor tip 78 to contact arbor-engaging surfaces 68 of plurality of tines 62 and force plurality of tines 62 away from central axis 82 into an expanded position from a contracted position. As illustrated in FIGS. 3 and 4, when gripping assembly 14 is in the disengaged position, collet 42 cooperates with arbor assembly 44 to form an expansion gap 160 between arbor-engaging surfaces 68 of plurality of tines 62 and tine-engaging surfaces 80 of arbor tip 78. During the transition between the disengaged and engaged positions of gripping assembly 14, expansion gap 160 decreases as tine-engaging surface 80 of arbor tip 78 engages arbor-engaging surface 68 of plurality of tines 62 to force tube-engaging surfaces 70 of plurality of tines 62 to engage inner surface 122 of tube 32 at collet-engaging end 136 as shown, for example, in FIGS. 5 and 6. This engagement creates contact forces between gripping assembly 14 and an inner surface 122 of tube 32 so that tube 32 can be mounted onto gripping assembly 14 and actuator system 12 without gripping outer surface 126 of tube 32 and without causing interference with die assembly 16.

After tube 32 is mounted on gripping assembly 14, first actuator 174 of actuator system 12 moves collet 42, tube stop 40, and arbor assembly 44 in tube-advancing direction 46 to advance tube 32 toward die assembly 16. First actuator 174 of actuator system 12 moves tube 32 in tube-advancing direction 46 and tube-rotating direction 48 to a predetermined location relative to die assembly 16 without plurality of tines 62 of gripping assembly 14 interfering with die assembly 16. During the remainder of the tube-bending process, arbor assembly 44 remains in the extended position and is moved with collet 42 to maintain gripping contact between gripping assembly 14 and inner surface 122 of tube 32.

To complete the bending process, die assembly 16 forms bends in tube 32. Die assembly 16 includes a bend die 20, a rotating pressure die 22, and a non-rotation pressure die 24. Such dies 20, 22, 24 are well known in the art and other configurations of die assemblies 16 may be used with gripping assembly 14 of the present invention.

As previously mentioned, first actuator 174 of actuator system 12 moves tube 32 to a predetermined position to position predetermined bending portion 128 of tube 32 near die assembly 16. Rotating and non-rotating pressure dies 22, 24 squeeze against bend die 20 in a pressurizing direction 34 and grip predetermined bending portion 128 of tube 32 as shown in FIG. 2. Next, bend die 20 and rotating pressure die 22 rotate in a tube-bending direction 38 about a rotational axis 36 of die assembly 16 as shown, for example, in FIG. 2. This rotation forces predetermined bending portion 128 of tube 32 to conform to a predetermined angle of rotation 52 and provides a desired amount of bend in tube 32 as shown in FIG. 1. Next, first actuator 174 of actuator system 12 moves the next predetermined bending portion 128 of tube 32 both radially and axially to the next predetermined bending position. After all the bending operations have been completed, gripping assembly 14 releases tube 32 and first actuator 174 returns gripping assembly 14 to a beginning position as shown in FIG. 1.

As previously mentioned, tube-bending machine 10 includes mandrel assembly 18. The function of mandrel assembly 18 is to reduce or eliminate the tendency of predetermined bending portion 128 of tube 32 to flatten out during the die rotating process previously mentioned. Mandrel assembly 18 includes a mandrel rod 26, a mandrel insert 28 having a length 25, a mandrel insert-link 29 having a first and second lengths 23, 27, and a plurality of mandrel balls 30 as shown, for example, in FIG. 2. Mandrel rod 26 has a first end 140 attached to second actuator 176 of actuator system 12 and a second end 142 spaced apart from first end 140. Mandrel insert-link 29 is attached to second end 142 of mandrel rod 26 and plurality of mandrel balls 30 are attached to mandrel insert-link 29. Length 25 of mandrel link 28 is made to the same length as second length 27 of mandrel insert-link 29. Furthermore, mandrel link-insert 29 is positioned to lie within mandrel link 28 as shown in FIG. 2.

Second actuator 176 of actuator system 12 moves plurality of mandrel rod 26 to position plurality of mandrel balls 30 between bend die 20 and rotating pressure die 22 within central aperture 120 of tube 32 located in predetermined bending portion 128 as shown, for example, in FIG. 2. By positioning plurality of mandrel balls 30 between bend die 20 and rotating pressure die 22, tube 32 has less of a tendency to flatten out because plurality of mandrel balls 30 fill central aperture 120 within tube 32 and restrict tube 32 from flattening out. Mandrel assembly 18 of the present invention is supplied by Bend Tooling, Inc. of Grand Rapids Mich. and is well known to those of ordinary skill in the art. Other types of mandrel assemblies may be used with gripping assembly 14 of the present invention.

As previously mentioned, arbor assembly 44 is formed to include a mandrel rod-receiving aperture 72. Mandrel rod 26 is positioned to lie substantially within mandrel rod-receiving aperture 72 and is attached to actuator system 12 at first end 140 of mandrel rod 26. According to the present invention, gripping assembly 14 is made in several sizes whereby mandrel rod-receiving apertures 72 of different sized gripping assemblies 14 can receive different sized mandrel rods 26. Thus, tubes 32 of various sizes can be bent and the size of mandrel rod 26 can be changed to optimize design characteristics for the particular application involved. For example, a larger mandrel rod can be used to attach to mandrel insert to reduce the potential for fatigue or other failures.

Conventional mandrel assemblies (not shown) used with conventional external collets (not shown) often use a mandrel body (not shown) to attach mandrel rod 26 and mandrel insert 28. However, according to the present invention, mandrel rod 26 is attached directly to mandrel insert 28 at second end 142 of mandrel rod 26 without using such a mandrel body. Therefore, a distance 162, measured from second end 142 of mandrel rod 26 to plurality of mandrel balls 30 as shown in FIG. 2, is less than that of conventional mandrel assemblies used with conventional external collets.

According to the present invention, inner surface 88 of tube stop 40 includes an expansion portion 214 having a first end 216 contiguous with the tube-engaging end 134 of the tube stop 40 and a second end 218 spaced apart from first end 216. Inner surface 88 of tube stop 40 is spaced apart from central axis 82 by a first distance 220 at the first end 216 of the expansion portion 214 and a second distance 222 at the second end 218 of the expansion portion 214. First distance 220 is greater than second distance 222. Plurality of tines 62 are positioned to lie partially in the expansion portion 214 while in the expanded position. Thus, when arbor assembly 44 moves from a disengaged position as shown in FIG. 3 to the engaged position as shown in FIG. 5 and plurality of tines 62 moves radially outward from the disengaged position to the engaged position, plurality of tines 62 interfere less with tube stop 40 because they are allowed to expand into expansion portion 214 as shown, for example, in FIG. 5.

By using gripping assembly 14, a minimum sized tube 32 is required to provide a bend in tube 32. During the tube bending process, the gripping assembly 14 grips tube 32 and maintains that grip during the multi-bend operation until the bend die assembly 16 clamps tube 32 on the final bend. Once die assembly 16 grips tube 32, gripping assembly 14 retracts to make room for the advancing components of die assembly 16. As gripping assembly 14 travels forward toward die assembly 16, there must be adequate clearance for die assembly 16. With gripping assembly 14, it is possible to advance tube 32 to within a minimal distance 138 of die assembly 16. As a result, minimal sized tubes 32 can be developed to complete the tube bending process.

Although this invention has been described in detail with reference to certain embodiments, variations and modifications exist within the scope and spirit of the invention as described and as defined in the following claims.

What is claimed is:

1. A tube-bending machine for bending a tubular work piece having an inner surface, the tube-bending machine comprising a work piece-bending die assembly, gripping means for gripping the inner surface of the tubular work piece, the gripping means including a mandrel rod-receiving aperture, a mandrel rod extending through the mandrel rod-receiving aperture in the gripping means and a tube passageway in the tubular work piece and defined by the inner surface, and a movement actuator system coupled to the gripping means to cause the tubular work piece gripped by the gripping means to move relative to and in engagement with the work piece-bending die assembly in response to movement of the gripping means relative to the work piece-bending die assembly to bend the tubular work piece, the gripping means including an expandable collet arranged to engage the inner surface of the tubular work piece and an arbor assembly positioned to expand the collet into engagement with the inner surface of the tubular work piece, and the arbor assembly being coupled to the movement actuator system and including the mandrel rod-receiving aperture.

2. The tube-bending machine of claim 1, wherein the collet includes an arbor-receiving passageway, the arbor assembly is positioned within the arbor-receiving passageway and is movable within the arbor-receiving passageway to expand the collet to engage the tubular work piece, and the mandrel rod is positioned within the arbor-receiving passageway in the collet while it extends through the mandrel rod-receiving aperture in the arbor assembly.

3. The tube-bending machine of claim 1, wherein the arbor assembly includes an arbor column having a first end and a second end spaced apart from the first end, an arbor tip having a tapered portion, a first end, and a second end spaced apart from the first end, and a mandrel rod-receiving passageway extending between the first end and the second end, the second end of the arbor tip being coupled to the first end of the arbor column, the tapered portion of the arbor tip including at least one tine-engaging surface, the arbor assembly being moved in relative axial motion to the collet by the actuator system from a retracted position to an extended position, the tine-engaging surface of the tapered portion of the arbor tip making contact with the collet during the movement of the arbor assembly relative to the collet and moving the collet from a contracted position to an expanded position, the collet making contact with the inner surface of the tube during movement of the collet from a disengaged position to an engaged position.

4. The tube-bending machine of claim 1, wherein the gripping means further includes a tube stop including a collet-receiving aperture and the collet and the arbor assembly are positioned within the collet-receiving aperture.

5. The tube-bending machine of claim 1, wherein the arbor assembly includes an arbor column and an arbor tip releasably coupled to the arbor column.

6. The tube-bending machine of claim 1, wherein the collet includes a base end, a tine end spaced apart from the base end, a plurality of tine attachment points positioned between the base end and the tine end, an inner surface defining an arbor-receiving passageway and a tapered portion, and a plurality of tines coupled to the tine attachment points, the plurality of tines cooperate to form a plurality of gap bulges positioned near the tine attachment points.

7. A tube-bending machine for bending a tubular work piece having an inner surface, the tube-bending machine comprising:

a work piece-bending die assembly, gripping means for gripping the inner surface of the tubular work piece, the gripping means including a mandrel rod-receiving aperture, the gripping means including an internal collet arranged to lie in the tube passageway in the tubular work piece adjacent to the inner surface of the tubular work piece, the collet including a passageway extending therethrough, the mandrel rod passing through the passageway in the collet, the gripping means further including an arbor assembly positioned to move in the passageway in the collet to urge the collet to assume an expanded configuration engaging the inner surface of the tubular work piece, the arbor assembly including the mandrel rod-receiving passageway, a mandrel rod extending through the mandrel rod-receiving aperture in the arbor assembly and a tube passageway in the tubular work piece and defined by the inner surface, and a movement actuator system coupled to the gripping means to cause the tubular work piece gripped by the gripping means to move relative to and in engagement with the work piece-bending die assembly in response to movement of the gripping means relative to the work piece-bending die assembly to bend the tubular work piece, the movement actuator system including a first actuator coupled to the collet and arbor assembly, a second actuator coupled to the mandrel rod, and a third actuator coupled to the arbor assembly.

8. The tube-bending machine of claim 7, wherein the arbor assembly includes an arbor column having a first end and a second end spaced apart from the first end, an arbor tip having a tapered portion, a first end, and a second end spaced apart from the first end, and a mandrel rod-receiving passageway extending between the first end and the second end, the second end of the arbor tip being coupled to the first end of the arbor column, the tapered portion of the arbor tip including at least one tine-engaging surface, the arbor assembly being moved in relative axial motion to the collet by the actuator system from a retracted position to an extended position, the tine-engaging surface of the tapered portion of the arbor tip making contact with the collet during the movement of the arbor assembly relative to the collet and moving the collet from a contracted position to an expanded position, the collet making contact with the inner surface of the tube during movement of the collet from a disengaged position to an engaged position.

9. The tube-bending machine of claim 7, wherein the gripping means further includes a tube stop including a collet-receiving aperture and the collet and the arbor assembly are positioned within the collet-receiving aperture.

10. The tube-bending machine of claim 7, wherein the arbor assembly includes an arbor column and an arbor tip is releasably coupled to the arbor column.

11. The tube-bending machine of claim 7, wherein the collet includes a base end, a tine end spaced apart from the base end, a plurality of tine attachment points positioned between the base end and the tine end, an inner surface defining the passageway and a tapered portion, and a plurality of tines coupled to the tine attachment points, the plurality of tines cooperate to form a plurality of gap bulges positioned near the tine attachment points.

12. A tube-bending machine for forming a tubular work piece having an inner surface, the tube-bending machine comprising a die assembly configured to form the tubular work piece to assume a bent shape, a collet arranged to grip the inner surface of the tubular work piece, the collet including an arbor-receiving aperture, an arbor assembly positioned within the arbor-receiving aperture in the collet and movable relative to the collet to expand the collet to grip the inner surface of the tubular work piece, the arbor assembly including a mandrel rod-receiving aperture, a mandrel rod being positioned within the mandrel rod-receiving aperture in the arbor assembly and extending through a tube passageway in the tubular work piece and defined by the inner surface, and an actuator system configured to move the collet, arbor assembly, and the tubular work piece gripped by the collet to predetermined positions relative to the die assembly to bend the tubular work piece in the die assembly.

13. The tube-bending machine of claim 6, wherein the actuator system includes a first actuator coupled to the collet and arbor assembly, a second actuator coupled to the mandrel rod, and a third actuator coupled to the arbor assembly.

14. The tube-bending machine of claim 6, wherein the arbor assembly includes an arbor column having a first end and a second end spaced apart from the first end, an arbor tip having a tapered portion, a first end, and a second end spaced apart from the first end, and a mandrel rod-receiving passageway extending between the first end and the second end, the second end of the arbor tip being coupled to the first end of the arbor column, the tapered portion of the arbor tip including at least one tine-engaging surface, the arbor assembly being moved in relative axial motion to the collet by the actuator system from a retracted position to an extended position, the tine-engaging surface of the tapered portion of the arbor tip making contact with the collet during the movement of the arbor assembly relative to the collet and moving the collet from a contracted position to an expanded position, the collet making contact with the inner surface of the tube during movement of the collet from a disengaged position to an engaged position.

15. The tube-bending machine of claim 12, further comprising a tube stop including a collet-receiving aperture, wherein the collet and the arbor assembly are positioned within the collet-receiving aperture.

16. The tube-bending machine of claim 12, wherein the arbor assembly includes an arbor column and an arbor tip releasably coupled to the arbor column.

17. The tube-bending machine of claim 12, wherein the collet includes a base end, a tine end spaced apart from the base end, a plurality of tine attachment points positioned between the base end and the tine end, an inner surface defining the arbor-receiving passageway and a tapered portion, and a plurality of tines coupled to the tine attachment points, the plurality of tines cooperate to form a plurality of gap bulges positioned near the tine attachment points.

18. A tube-bending machine for forming a tubular work piece having an inner surface, the tube-bending machine comprising a die assembly configured to form the tubular work piece to assume a bent shape, an actuator system configured to move the tubular work piece to predetermined positions relative to the die assembly, a mandrel assembly including a mandrel rod having a first end and a second end spaced apart from the first end and a plurality of mandrel balls coupled to the second end of the mandrel rod, the first end of the mandrel rod being coupled to the actuator system, and gripping means for gripping the inner surface of the tubular work piece, the gripping means being coupled to the actuator system and including a mandrel rod-receiving aperture, the mandrel rod being positioned within the mandrel rod-receiving aperture, the gripping means including a collet arranged to engage the inner surface of the tubular work piece and an arbor arranged to engage the collet to expand the collet into engagement with the inner surface of the tubular work piece, the mandrel rod-receiving aperture being included in the arbor to permit movement of the mandrel rod relative to the gripping means by the actuator system.

19. The tube-bending machine of claim 18, wherein the collet includes a base end, a tine end spaced apart from the base end, and an inner surface forming an arbor-receiving passageway extending between the base end and the tine end, the arbor is positioned within the arbor-receiving passageway.

20. The tube-bending machine of claim 19, wherein the collet further includes a central axis, a plurality of tine attachment points situated between the tine end and the base end and a plurality of tines coupled to the tine attachment points of the collet, each of the plurality of tines includes an arbor-engaging surface facing toward the central axis and a tube-engaging surface spaced apart from the arbor-engaging surface and facing away from the central axis, and the arbor-engaging surface forms a tapered portion tapered relative to the central axis.

21. A tube-bending machine for forming a tubular work piece having an inner surface the tube-bending machine comprising p1 a die assembly configured to form the tubular work piece to assume a bent shape, an actuator system configured to move the tubular work piece to predetermined positions relative to the die assembly, a mandrel assembly including a mandrel rod having a first end and a second end spaced apart from the first end and a plurality of mandrel balls coupled to the second end of the mandrel rod, the first end of the mandrel rod being coupled to the actuator system, and gripping means for gripping the inner surface of the tubular work piece, the gripping means being coupled to the actuator system and including a mandrel rod-receiving aperture, the mandrel rod being positioned within the mandrel rod-receiving aperture, the gripping means including engaging means for engaging the inner surface of the tubular work piece and moving means for moving the engaging means between a contracted positioned spaced apart from the inner surface of the tubular work piece and an expanded position engaged with the inner surface of the tubular work piece, the engaging means including a collet having a base end, a tine end spaced apart from the base end, and an inner surface forming an arbor assembly-receiving passageway extending between the base end and the tine end, the moving means including an arbor assembly, the collet further including a plurality of tine attachment points situated between the tine end and the base end and a plurality of tines coupled to the tine attachment points of the collet, each of the plurality of tines including an arbor assembly-engaging surface facing toward the central axis and a tube-engaging surface spaced apart from the arbor assembly-engaging surface and facing away from the central axis, the inner surface forming a tapered portion tapered relative to the central axis, the arbor assembly being positioned within the collet and includes an arbor column having a first end and a second end spaced apart from the first end, an arbor tip having a tapered portion, a first end, and a second end spaced apart from the first end, and a mandrel rod-receiving passageway extending between the first end and the second end, the second end of the arbor tip being coupled to the first end of the arbor column, the tapered portion of the arbor tip including at least one tine-engaging surface, the arbor assembly being moved in relative axial motion to the collet by the actuator from a retracted position to an extended position, the tine-engaging surface of the tapered portion of the arbor tip making contact with the collet during the movement of the arbor assembly relative to the collet and moving the collet from a contracted position to an expanded position, the collet making contact with the inner surface of the tube during movement of the collet from a disengaged position to an engaged position.

22. The tube-bending machine of claim 21, wherein the actuator system includes a first actuator coupled to the collet and arbor assembly, a second actuator coupled to the mandrel rod, and a third actuator coupled to the arbor assembly.

23. The tube-bending machine of claim 21, further comprising a tube stop including a collet-receiving aperture, wherein the collet and the arbor assembly are positioned within the collet-receiving aperture.

24. The tube-bending machine of claim 21, wherein the arbor tip is releasably coupled to first end of the arbor column.

25. The tube-bending machine of claim 21, wherein the plurality of tines cooperate to form a plurality of gap bulges positioned near the tine attachment points.

26. A tube bender for bending a tube having an inner surface, the tube bender comprising a die assembly configured to form the tube to assume a desired shape, a gripping assembly including a central axis, a collet configured to grip the inner surface of the tube, an arbor configured to expand the collet, and a mandrel rod-receiving passageway, a mandrel rod extending through the mandrel rod-receiving passageway in the collet during a bending process, and an actuator configured to move the gripping assembly and the tube gripped by the gripping assembly relative to the die assembly to cause the tube to assume the desired shape.

27. A tube bender for bending a tube having an inner surface, the tube bender comprising a die assembly configured to form the tube to assume a desired shape, a gripping assembly including a central axis, a collet configured to grip the inner surface of the tube, an arbor configured to expand the collet, and a mandrel rod-receiving passageway, a mandrel rod extending through the mandrel rod-receiving passageway during a bending process, and an actuator configured to move the gripping assembly and the tube gripped by the gripping assembly relative to the die assembly to cause the tube to assume the desired shape, the gripping assembly further including a tube stop including a collet-receiving aperture with the collet and the arbor positioned within the collet-receiving aperture.

28. The tube bender of claim 26, wherein the actuator is configured to move the arbor assembly relative to the collet between a retracted position and an extended position to move the collet between an contracted position and an expanded position, and the collet includes a tube-engaging surface facing away from the central axis and configured to grip an inner surface of a tube when the collet is in the expanded position.

29. The tube bender of claim 26, wherein the actuator includes a first actuator coupled to the collet and arbor, a second actuator coupled to the mandrel rod, and a third actuator coupled to the arbor.

30. The tube bender of claim 26, wherein the arbor includes an arbor column having a first end and a second end spaced apart from the first end, an arbor tip having a tapered portion, a first end, and a second end spaced apart from the first end, and a mandrel rod-receiving passageway extending between the first end and the second end, the second end of the arbor tip being coupled to the first end of the arbor column, the tapered portion of the arbor tip including at least one tine-engaging surface, the arbor being moved in relative axial motion to the collet by the actuator from a retracted position to an extended position, the tine-engaging surface of the tapered portion of the arbor tip making contact with the collet during the movement of the arbor relative to the collet and moving the collet from a contracted position to an expanded position, the collet making contact with the inner surface of the tube during movement of the collet from a disengaged position to an engaged position.

31. The tube bender of claim 26, wherein the gripping assembly further includes a tube stop including a collet-receiving aperture and the collet and the arbor are positioned within the collet-receiving aperture.

32. The tube bender of claim 26, wherein the arbor includes an arbor column and an arbor tip is releasably coupled to the arbor column.

33. The tube bender of claim 26, wherein the collet includes a base end, a tine end spaced apart from the base end, a plurality of tine attachment points positioned between the base end and the tine end, an inner surface defining an arbor-receiving passageway and a tapered portion, and a plurality of tines coupled to the tine attachment points, the plurality of tines cooperate to form a plurality of gap bulges positioned near the tine attachment points.

34. The tube bender of claim 27, wherein the tube stop includes a tube-engaging end configured to abut against an edge of the tube.

35. The tube bender of claim 28, wherein the arbor assembly includes a foot end coupled to the actuator, a tip end spaced apart from the foot end, and a tip positioned adjacent the tip end, the arbor assembly includes the mandrel rod-receiving aperture, and the tip includes an outer surface facing away from the central axis and being tapered relative to the central axis.

36. The tube bender of claim 28, wherein the collet includes an inner surface facing toward the central axis and being engaged with the tip of the arbor assembly when the arbor assembly is in the extended position.

37. The tube bender of claim 36, wherein the collet includes a plurality of tines and the tines include the tube-engaging surface that is configured to engage an inner surface of a tube when the collet is in the expanded position.

38. A method of gripping a tube, the method comprising the steps of providing a tube having a collet-engaging end and an inner surface, a tube bender including a gripping assembly and a mandrel assembly having a mandrel rod, the gripping assembly including a collet having a plurality of tines, and an arbor assembly having a mandrel rod-receiving passageway, the mandrel rod extending through the mandrel rod-receiving aperture, placing the collet-engaging end of the tube over the plurality of tines of the collet, and moving the arbor assembly relative to the collet so that the arbor assembly expands the plurality of tines to an expanded position so that plurality of tines grip the inner surface of the tube.

39. The method of claim 38, the tube bender further includes a die assembly, the mandrel assembly further includes a mandrel ball assembly coupled to the mandrel rod and positioned within the tube, and the method further comprising the step of moving the mandrel rod so that the mandrel ball assembly is situated adjacent to the die assembly after moving the arbor assembly relative to the collet.

40. The method of claim 39, further comprising the step of moving the gripping assembly and tube relative to the die assembly after moving the mandrel rod.

41. The method of claim 40, further comprising the step of substantially retaining the position of the mandrel assembly relative to the die assembly after moving the gripping assembly and the tube.

42. A gripping assembly for gripping a tube for use on a tube bender having a mandrel assembly including a mandrel rod, the tube having an inner surface, the gripping assembly having a central axis, the gripping assembly comprising a collet including a base end, a tine end spaced apart from the base end, a plurality of tine attachment points positioned between the base end and the tine end, an inner surface facing toward the central axis and defining an arbor-receiving passageway and a tapered portion tapered relative to the central axis, and a plurality of tines coupled to the tine attachment points, each of the plurality of tines including an arbor-engaging surface facing toward the central axis and a tube-engaging surface spaced apart from the arbor-engaging surface and facing away from the central axis, an arbor assembly positioned within the arbor-receiving passageway of the collet, the arbor assembly including a foot end, an arbor tip end spaced apart from the foot end, an inner surface defining a mandrel rod-receiving passageway, and a tapered portion positioned at the arbor tip end, the tapered portion including at least one tine-engaging surface facing away from the central axis and being tapered relative to the central axis, and the mandrel rod being arranged to extend into the mandrel rod-receiving passageway, and an actuator configured to move the arbor assembly from a retracted position to an extended position relative to the collet, the tine-engaging surface of the tapered portion of the arbor assembly making contact with the arbor-engaging surface of the plurality of tines during movement of the arbor assembly relative to the collet and moving the tines radially outward from the central axis from a contracted position to an expanded position, and the tube-engaging surfaces of plurality of tines arranged to contact the inner surface of the tube when the plurality of tines are in the expanded position.

43. A gripping assembly for gripping a tube for use on a tube bender having a mandrel assembly including a mandrel rod, the tube having an inner surface, the gripping assembly having a central axis, the gripping assembly comprising a collet including a base end, a tine end spaced apart from the base end, a plurality of tine attachment points positioned between the base end and the tine end, an inner surface facing toward the central axis and defining an arbor-receiving passageway and a tapered portion tapered relative to the central axis, and a plurality of tines to the tine attachment points, each of the plurality of tines including an arbor-engaging surface facing toward the central axis and a tube-engaging surface spaced apart from the arbor-engaging surface and facing away from the central axis, an arbor positioned in the arbor-receiving passageway of the collet, the arbor including a foot end, an arbor tip end spaced apart from the foot end, an inner surface defining a mandrel rod-receiving passageway and a tapered portion positioned at the arbor tip end, the tapered portion including at least one tine-engaging surface facing away from the central axis and being tapered relative to the central axis, and the mandrel rod being arranged to extend into the mandrel rod-receiving passageway, an actuator configured to move the arbor from a retracted position to an extended position relative to the collet, the tine-engaging surface of the tapered portion of the arbor making contact with the arbor-engaging surface of the plurality of tines during movement of the arbor relative to the collet and moving the tines radially outward from the central axis from a contracted position to an expanded position, and the tube-engaging surfaces of plurality of tines arranged to contact the inner surface of the tube when the plurality of tines are in the expanded position, and a tube stop having a mount end, a tube-engaging end spaced apart from the mount end, and a collet-receiving aperture extending between the mount end and the tube-engaging end, the collet being positioned within the collet-receiving aperture.

44. The gripping assembly of claim 42, wherein the plurality of tines include spaced-apart first, second, and third tines.

45. The gripping assembly of claim 42, further comprising a plurality of tine pads having an outer surface facing away from the central axis and arranged to engage the inner surface of the tube, each of the plurality of tines including a tine pad-engaging surface facing away from the central axis, one of the plurality of tine pads being coupled to each of the tine pad-engaging surfaces.

46. A gripping assembly for gripping a tube for use on a tube bender having a mandrel assembly including a mandrel rod, the tube having an inner surface, the gripping assembly having a central axis, the gripping assembly comprising a collet including a base end, a tine end spaced apart from the base end, a plurality of tine attachment points positioned between the base end and the tine end, an inner surface facing toward the central axis and defining an arbor-receiving passageway and a tapered portion tapered relative to the central axis, and a plurality of tines coupled to the tine attachment points, each of the plurality of tines including an arbor-engaging surface facing toward the central axis and a tube-engaging surface spaced apart from the arbor-engaging surface and facing away from the central axis, an arbor assembly positioned within the arbor-receiving passageway of the collet, the arbor assembly including a foot end, an arbor tip end spaced apart from the foot end, an inner surface defining a mandrel rod-receiving passageway, and a tapered portion positioned at the arbor tip end the tapered portion including at least one tine-engaging surface facing away from the central axis and being tapered relative to the central axis, and the mandrel rod being arranged to extend into the mandrel rod-receiving passageway, and an actuator configured to move the arbor assembly from a retracted position to an extended position relative to the collet, the tine-engaging surface of the tapered portion of the arbor assembly making contact with the arbor-engaging surface of the plurality of tines during movement of the arbor assembly relative to the collet and moving the tines radially outward from the central axis from a contracted position to an expanded position, and the tube-engaging surfaces of plurality of tines arranged to contact the inner surface of the tube when the plurality of tines are in the expanded position the arbor assembly including an arbor column having a first end and a second end contiguous with the foot end of the arbor assembly and spaced apart from the first end and an arbor tip having a first end contiguous with the arbor tip end of the arbor assembly and a second end spaced apart from the first end, and the second end of the arbor tip being releasably coupled to first end of the arbor column.

47. The gripping assembly of claim 42, wherein the tapered portion of the inner surface of the collet is shaped as a truncated cone and the tapered portion of the arbor assembly is shaped as a truncated cone.

48. A gripping assembly for gripping a tube for use on a tube bender having a mandrel assembly including a mandrel rod, the tube having an inner surface, the gripping assembly having a central axis the gripping assembly comprising a collet including a base end, a tine end spaced apart from the base end, a plurality of tine attachment points positioned between the base end and the tine end, an inner surface facing toward the central axis and defining an arbor-receiving passageway and a tapered portion tapered relative to the central axis, and a plurality of tines coupled to the tine attachment points, each of the plurality of tines including an arbor-engaging surface facing toward the central axis and a tube-engaging surface spaced apart from the arbor-engaging surface and facing away from the central axis, an arbor assembly positioned within the arbor-receiving passageway of the collet, the arbor assembly including a foot end, an arbor tip end spaced apart from the foot end, an inner surface defining a mandrel rod-receiving passageway, and a tapered portion positioned at the arbor tip end, the tapered portion including at least one tine-engaging surface facing away from the central axis and being tapered relative to the central axis, and the mandrel rod being arranged to extend into the mandrel rod-receiving passageway, and an actuator configured to move the arbor assembly from a retracted position to an extended position relative to the collet, the tine-engaging surface of the tapered portion of the arbor assembly making contact with the arbor-engaging surface of the plurality of tines during movement of the arbor assembly relative to the collet and moving the tines radially outward from the central axis from a contracted position to an expanded position, and the tube-engaging surfaces of plurality of tines arranged to contact the inner surface of the tube when the plurality of tines are in the expanded position, the plurality of tines cooperate to form a plurality of gap bulges positioned near the tine attachment points.

49. The gripping assembly of claim 43, wherein the tube stop further includes an inner surface having an expansion portion including a first end contiguous with the tube-engaging end of the tube stop and a second end spaced apart from the first end, the inner surface of the tube stop is spaced apart from the central axis by a first distance at the first end of the expansion portion and a second distance at the second end of the expansion portion, the first distance is greater than the second distance, and the plurality of tines are positioned within the expansion portion.

50. The gripping assembly of claim 45, wherein the plurality of tines include spaced-apart first, second, and third tines and the plurality of tine pads include spaced-apart first, second, and third tine pads.

51. The gripping assembly of claim 46, wherein the inner surface of the arbor assembly includes a threaded portion at the first end of the arbor column, the second end of the arbor tip includes a threaded portion, and the second end of the arbor tip is threadingly engaged with the first end of the arbor column.

52. The gripping assembly of claim 46, wherein the actuator includes a first actuator coupled to the collet and arbor assembly, a second actuator coupled to the mandrel rod, and a third actuator coupled to the arbor assembly.

53. The gripping assembly of claim 46, further comprising a tube stop including a collet-receiving aperture, wherein the collet and the arbor assembly are positioned within the collet-receiving aperture.

54. The gripping assembly of claim 46, wherein the plurality of tines cooperate to form a plurality of gap bulges positioned near the tine attachment points.

55. The gripping assembly of claim 51, wherein the arbor tip further includes wrench flats.

56. The gripping assembly of claim 47, wherein the tapered portion of the arbor assembly includes a first end contiguous with the arbor tip end of the arbor assembly and a second end spaced apart from the first end, and the inner surface is spaced apart from the central axis by a first distance at the first end of the tapered portion and a second distance at the second end of the tapered portion that is greater than the first distance.

57. The gripping assembly of claim 47, wherein cross sections perpendicular to the central axis of the truncated cones are substantially round.

* * * * *